US006387458B1

(12) United States Patent
Yamashita et al.

(10) Patent No.: US 6,387,458 B1
(45) **Date of Patent: *May 14, 2002**

(54) REVERSE PAINTING PROCESS

(75) Inventors: Yukihide Yamashita; Masayuki Yamaguchi; Shirou Kamiyama; Kenichirou Mori, all of Sayama (JP)

(73) Assignee: Honda Giken Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/909,869

(22) Filed: Aug. 12, 1997

(30) Foreign Application Priority Data

Aug. 28, 1996 (JP) ..... 8-226995

(51) Int. Cl.[7] ..... B05D 3/02; B05D 1/06; B05D 1/36

(52) U.S. Cl. ..... 427/470; 427/195; 427/201; 427/314; 427/374.4; 427/375; 427/385.5; 427/407.1

(58) Field of Search ..... 427/470, 195, 427/203, 314, 375, 374.4, 385.5, 407.1, 374.3

(56) References Cited

U.S. PATENT DOCUMENTS

| | | | | | |
|---|---|---|---|---|---|
| 4,180,652 | A | * | 12/1979 | Nogami et al. | 525/437 |
| 4,208,262 | A | * | 6/1980 | Kubo et al. | 204/181 T |
| 4,333,807 | A | * | 6/1982 | Suzuki et al. | 204/181 T |
| 5,045,114 | A | * | 9/1991 | Bigalk et al. | 106/404 |
| 5,288,324 | A | * | 2/1994 | Shaneyfelt | 118/326 |

FOREIGN PATENT DOCUMENTS

| | | |
|---|---|---|
| GB | 816312 | 7/1959 |
| JP | 56-10397 | 3/1981 |
| JP | 62-2640 | 3/1984 |

OTHER PUBLICATIONS

Nov. 19, 1997 Communication from the British Patent Office and enclosed Search Report.

* cited by examiner

*Primary Examiner*—Michael Barr
(74) *Attorney, Agent, or Firm*—Merchant & Gould, P.C.

(57) ABSTRACT

A reverse painting process includes the preheating of work prior to its powder coating. By the preheating of the work, it becomes possible to form a film having a sufficiently large thickness for maintaining a satisfactorily high level of rustproofness in the boundary area between a film of the powdery paint and a film formed by electrodeposition, thus achieving drastic shortening of the time required for heating it in the fusing oven.

2 Claims, 9 Drawing Sheets

REVERSE PAINTING PROCESS

BACKGROUND OF THE INVENTION

1. Field of the Invention

This invention relates to a reverse painting process which is suitable for painting a vehicle body.

2. Description of the Related Art

There is a method which comprises forming a powder coating on, for example, a part of a vehicle body, giving it heat treatment, and forming an electrodeposited coating on the rest thereof. This method is called reverse painting, and has been drawing attention as a method of painting a vehicle body owing to, for example, a thick film which can easily be formed by powder coating. There have been proposed a number of reverse painting processes as disclosed in (1) Japanese Patent Publication No. SHO 56-10397 entitled "A Process for Painting an Automobile Body", and (2) Japanese Patent Publication No. SHO 62-2640 entitled "A Reverse Painting Process".

FIG. 7 hereof is a chart showing a conventional reverse painting process, or the process as disclosed in (1). It comprises applying a powdery paint to the outer plate of an automobile body, melting it by heat to form a film thereon, coating the inner plate of the body with a film formed by electrodeposition, and baking both of the films together to cure them by heat.

FIG. 8 hereof is a chart showing another conventional reverse painting process, or the process as disclosed in (2). It comprises applying a powdery paint to a part of an article to be painted, fusing it by heat to form a film thereon, coating the other part of the article with a film formed by electrodeposition, washing the films with water, drying them, and baking them together. If they are baked immediately after washing with water, water marks are likely to form. Therefore, the process includes the drying step for evaporating water, so that no water mark may form.

The processes as disclosed in the prior Japanese patent publications (1) and (2) have the steps of powder coating, fusing, and electrodeposition in common. Referring more particularly to the fusing step, FIG. 9 is a graph showing the fusing temperature and time as employed in the conventional processes, and shows the temperature (° C.) along the ordinate axis and the time (minutes) along the abscissa axis.

Referring more particularly to FIG. 9, a vehicle body remaining at room temperature (15° C.) is coated with a powdery paint, and placed in a fusing oven. The vehicle body is composed of a skin, sash, beam, hinge, etc., and while the skin having the smallest thickness of all is heated in a short time, the hinge having the largest thickness of all is not heated quickly. Therefore, the vehicle body is heated in the oven for 36 minutes until the fusion of the paint on the hinge is completed. The skin is necessarily held at a high temperature for a long time.

FIGS. 10(*a*) to 10(*d*) are a series of diagrams showing a conventional pattern of reverse painting. FIG. 10(*a*) shows a multiplicity of coating powder particles 101 applied to a part of the upper surface of a skin 100 and held adhering to it by an electric attracting force, and a number of coating powder particles 101*a* scattered on the skin near the right end of a powder coating area A adjacent to an electrodeposition area B. If they are heated, the particles 101 are partly melted together, while the particles 101*a* are shaped like bells, as shown in FIG. 10(*b*).

If they are further heated, a substantially flat coating film 102 is formed on the skin in the powder coating area A except in the vicinity of its end portion where the particles 101*a* shown in FIG. 10(*b*) form films 101*b* shaped like low hills, as shown in FIG. 10(*c*). Then, electrodeposition is carried out to cover any portion of the skin not covered with the film 101*b* or 102. As a result, shallot-shaped films 105 are formed in a boundary area between the film 102 formed by powder coating and a flat film 104 formed by electrodeposition, as shown in FIG. 10(*d*).

Each hill-shaped film 101*b* has, however, a very thin portion having a thickness of only, say, 5 microns which is too small for any satisfactory rustproofness. The boundary area is, therefore, undesirably low in rustproofness.

SUMMARY OF THE INVENTION

It is, therefore, an object of this invention to provide a painting process which can improve the rustproofness of the boundary between an area of powder coating and an area of electrodeposition.

As a result of our review of the prior art, we, the inventors of this invention, have found that the small thickness of the films 101*b* which is responsible for the undesirably low rustproofness of the boundary area is due to the excessive deformation by heat of the particles in that area, and that such deformation is due to the prolonged exposure of the skin to a high temperature as required for heating the hinge having a larger heat capacity. We have, therefore, considered that the shortening of the time for heating the skin will be an effective solution to the outstanding problem.

We have thought of the local heating of the hinge and beam, but found it difficult to realize in any ordinary heating oven. We have, therefore, thought of preheating a vehicle body to be painted, and found that the skin is cooled soon after preheating, though the hinge, etc. having a larger heat capacity are not cooled soon, and that if the vehicle body is placed in a fusing oven at a proper timing while the hinge, etc. are still hot, it is possible to heat the hinge, etc. to an appropriate fusing temperature and thereby shorten the time which is required for the adequate heating of the vehicle body as a whole.

FIG. 1 is a chart showing a reverse painting process embodying this invention and including, after the preliminary step of washing a piece of work to be painted, the steps of preheating the work, while evaporating any water remaining on it after washing, applying a powdery paint to the preheated work, heating it in a fusing oven to form a coating film on the work, coating the work with a film formed by electrodeposition, and baking both of those films. Although FIG. 1 includes the preliminary step of washing, it and the step of evaporating any water (or the drying step) can be carried out in a separate line, so that the process according to this invention may start with the preheating step.

FIGS. 2(*a*) to 2(*c*) show a pattern of reverse painting according to the process embodying this invention. FIG. 2(*a*) shows coating powder particles 2 applied to a part of the upper surface of a skin 1 and held adhering to it by an electric attracting force, and coating powder particles 2*a* scattered on the skin near the right end of a powder coating area A adjacent to an electrodeposition area B. After only a short time of heating, the particles 2*a* are slightly melted and adhere to the skin 1, as shown in FIG. 2(*b*). If electrodeposition is, then, carried out to form a film 5, films 6 are also formed in the boundary area between a film 3 formed from the particles 2 and the film 5 so as to fill the open spaces left around the bell-shaped particles 2*a,* as shown in FIG. 2(*c*). The bell-shaped particles 2*a* have a thickness D2 which is sufficiently large for forming a rustproof film in the boundary area.

According to a first aspect of this invention, there is, thus, provided a reverse painting process which comprises the steps of preheating the work to be painted, applying a powdery paint to the work upon cooling of the work to below the crosslinking and curing temperature of the paint, melting the paint by heat at a temperature not below its softening point, but below its crosslinking and curing temperature to form a film on the work in a fusing oven before the work is cooled to ordinary temperature, and coating the work with a film formed by electrodeposition.

Provision of the work preheating step makes it possible to form a film having a sufficiently large thickness for maintaining a satisfactorily high level of rustproofness in the boundary area between a film of the powdery paint and a film formed by electrodeposition, thus achieving drastic shortening of the time required for heating it in the fusing oven.

According to a second aspect of this invention, there is provided a reverse painting process which comprises the steps of washing the work to be painted, preheating the work, while evaporating any water remaining on it after washing, applying a powdery paint to the work upon cooling of the work to below the crosslinking and curing temperature of the paint, melting the paint by heat at a temperature not below its softening point, but below its crosslinking and curing temperature to form a film on the work in a fusing oven before the work is cooled to ordinary temperature, and coating the work with a film formed by electrodeposition.

The preheating of the work can be performed in a drying oven which is used for evaporating any water from the work after washing. If any existing drying oven can be used, it is possible to cut down the cost of equipment for carrying out the process of this invention accordingly.

Moreover, provision of the work preheating step makes it possible to form a film having a sufficiently large thickness for maintaining a satisfactorily high level of rustproofness in the boundary area between a film of the powdery paint and a film formed by electrodeposition, thus achieving drastic shortening of the time required for heating it in the fusing oven.

BRIEF DESCRIPTION OF THE DRAWINGS

Preferred embodiments of this invention will now be described in detail, by way of example, with reference to the accompanying drawings, in which.

DETAILED DESCRIPTION OF THE PREFERRED EMBODIMENTS

The invention will now be described by way of its preferred embodiments, though the following description is not intended for limiting the process of this invention.

Figure 1:
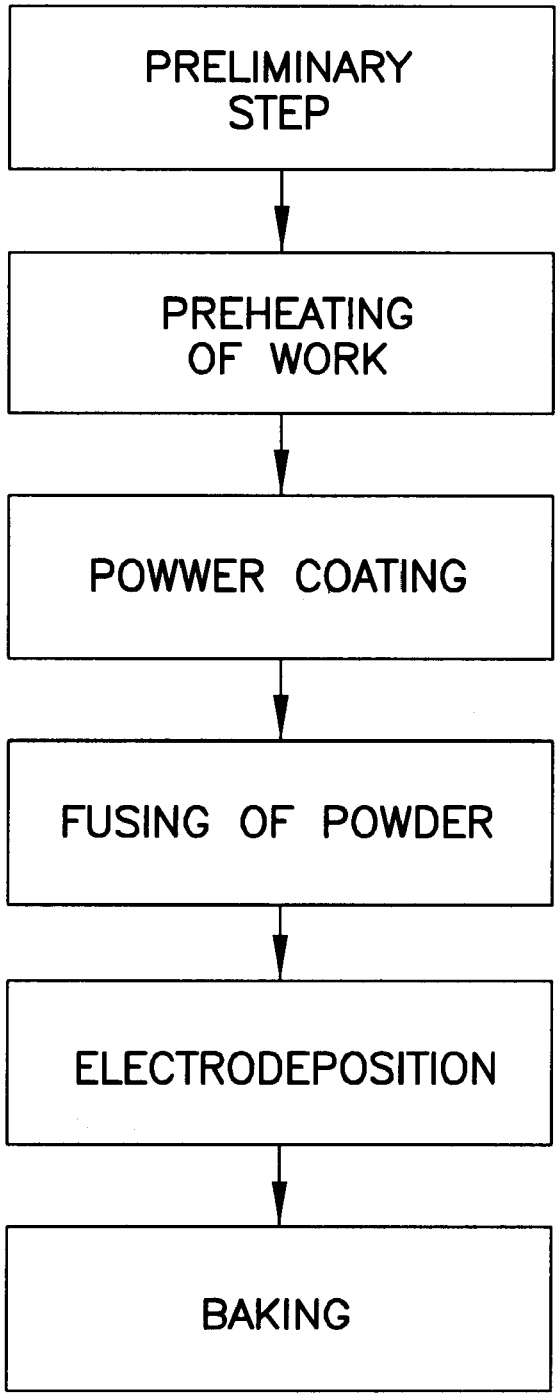
FIG. 1 is a chart showing a reverse painting process embodying this invention.
Figure 2:
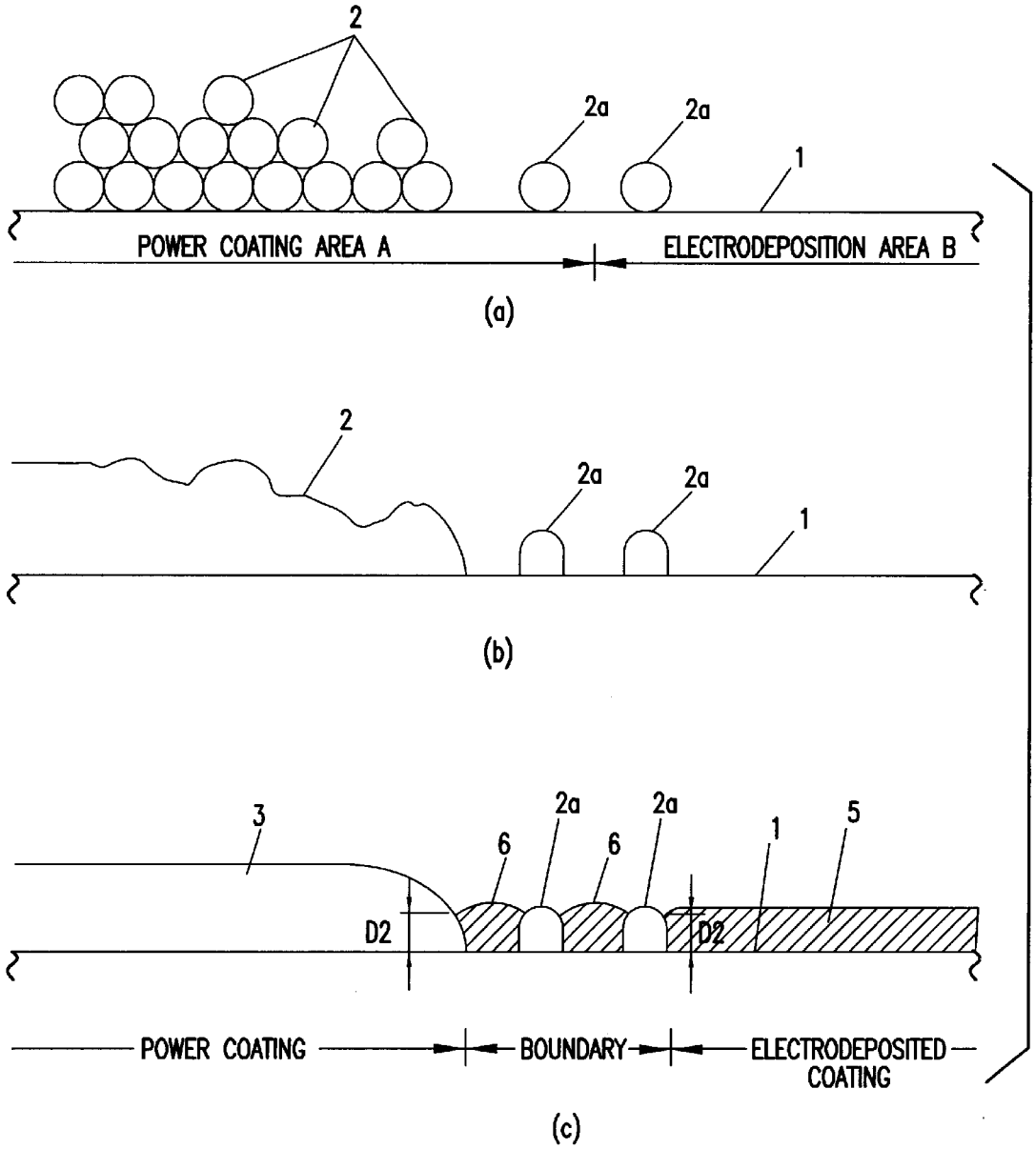
FIGS. 2(*a*), 2(*b*), and 2(*c*) are a set of diagrams showing a pattern of reverse painting by the process embodying this invention.
Figure 3:
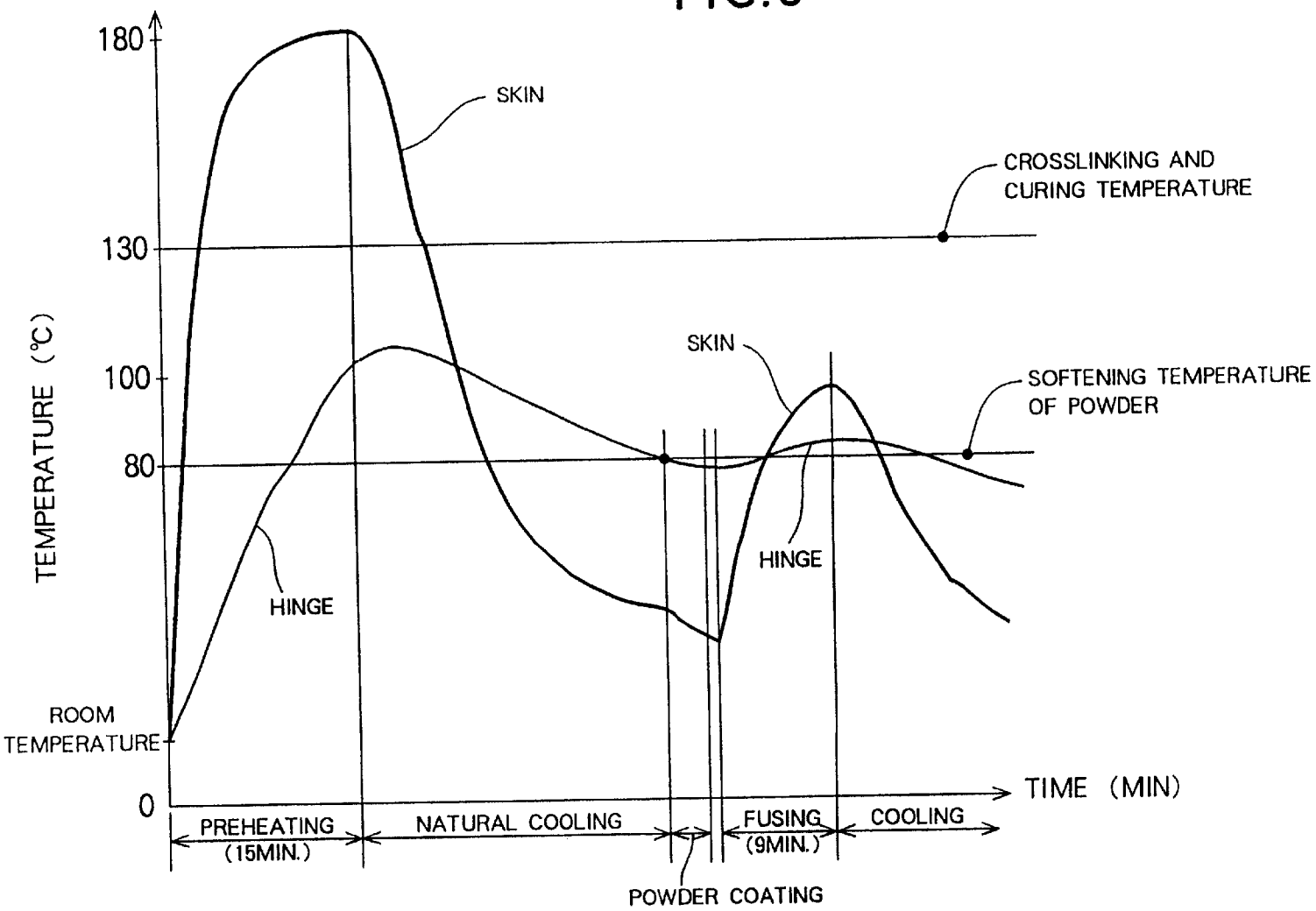
FIG. 3 is a graph showing the temperature and time relationship existing in the former half of the process embodying this invention.

FIG. 3 is a graph showing the temperature and time relationship existing in the former half of a reverse painting process embodying this invention, and shows the temperature (° C.) along the ordinate axis and the time (min.) along the abscissa axis.

The article to be painted is an automobile body having a skin formed from a 0.7 mm thick carbon steel sheet (plated or not plated) and a hinge formed from 5.5 mm thick carbon steel sheet. The automobile body is held in a preheating oven having a temperature of 180° C. for 15 minutes, whereby its skin is heated to 180° C., and its hinge to about 105° C., as shown in the preheating part of FIG. 3. Then, the body is removed from the oven, and allowed to cool. The hinge has, however, a delayed start in cooling due to thermal inertia, and a low cooling rate because of its large heat capacity, as shown in the natural cooling part of FIG. 3.

Upon cooling of the hinge to 80° C., a powdery paint is applied to the body to form a coating film having a thickness of 45 microns, as shown in the powder coating part of FIG. 3. The paint is a product of Nippon Paint Company having a softening temperature of 80° C., a crosslinking and curing temperature of 130° C. and an average particle diameter of 25 microns. Then, the body is held in a fusing oven having a temperature of 100° C. for nine minutes, as shown in the fusing part of FIG. 3. The skin and hinge exceed 80° C. (the solidifying temperature of the paint) in four or five minutes after the body has been placed in the oven, and the paint is thoroughly fused during the remaining period of about four minutes. Then, the body is removed from the oven, and cooled.

After it has been cooled to ordinary, or room temperature, an electrodeposition paint(a product of Nippon Paint Company) is applied to the body to form an electrodeposited film having a thickness of 25 microns, though not shown in FIG. 3.-

The process as described above was employed for preparing painted samples for (1) an examination for any variation of film thickness, (2) a salt spray test and (3) a complex corrosion resistance test. These tests were conducted on both of the samples formed from plated steel sheets and those formed from non-plated steel sheets. The examination or tests and the results thereof will now be described.

(1) Examination for a variation of film thickness

Figure 4:
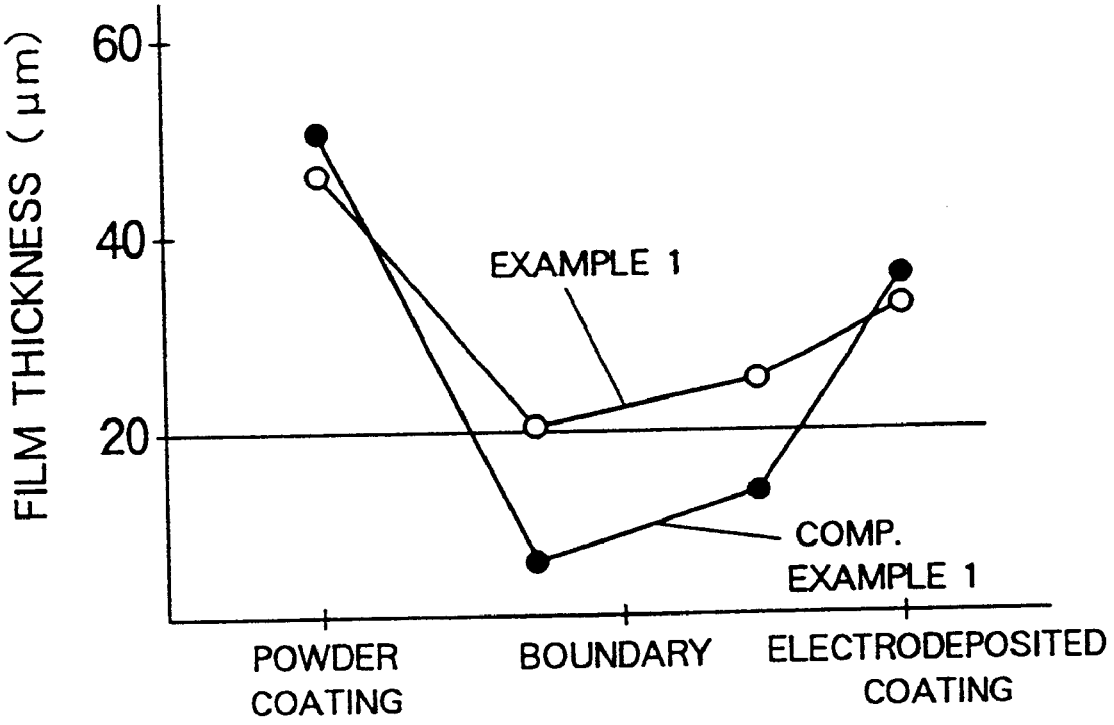
FIG. 4 is a graph showing the results of an examination for a variation of film thickness.

FIG. 4 is a graph showing the results of an examination for any variation of film thickness, and shows the film thickness along the ordinate axis and the point of its measurement along the abscissa axis.

EXAMPLE 1

The temperature and time relationship as shown in FIG. 3 was employed in the former half of the reverse painting process. The results are shown by white circles in FIG. 4. The film had a thickness of 45 microns in the powder coating area at a distance of 30 mm from the boundary area, a thickness of 20 microns in the boundary area and a thickness of 32 microns in the electrodeposition area at a distance of 30 mm from the boundary area. It had a thickness of 20 microns even in its boundary area where it had a smaller thickness than in any other area.

Comparative Example 1

Figure 9:
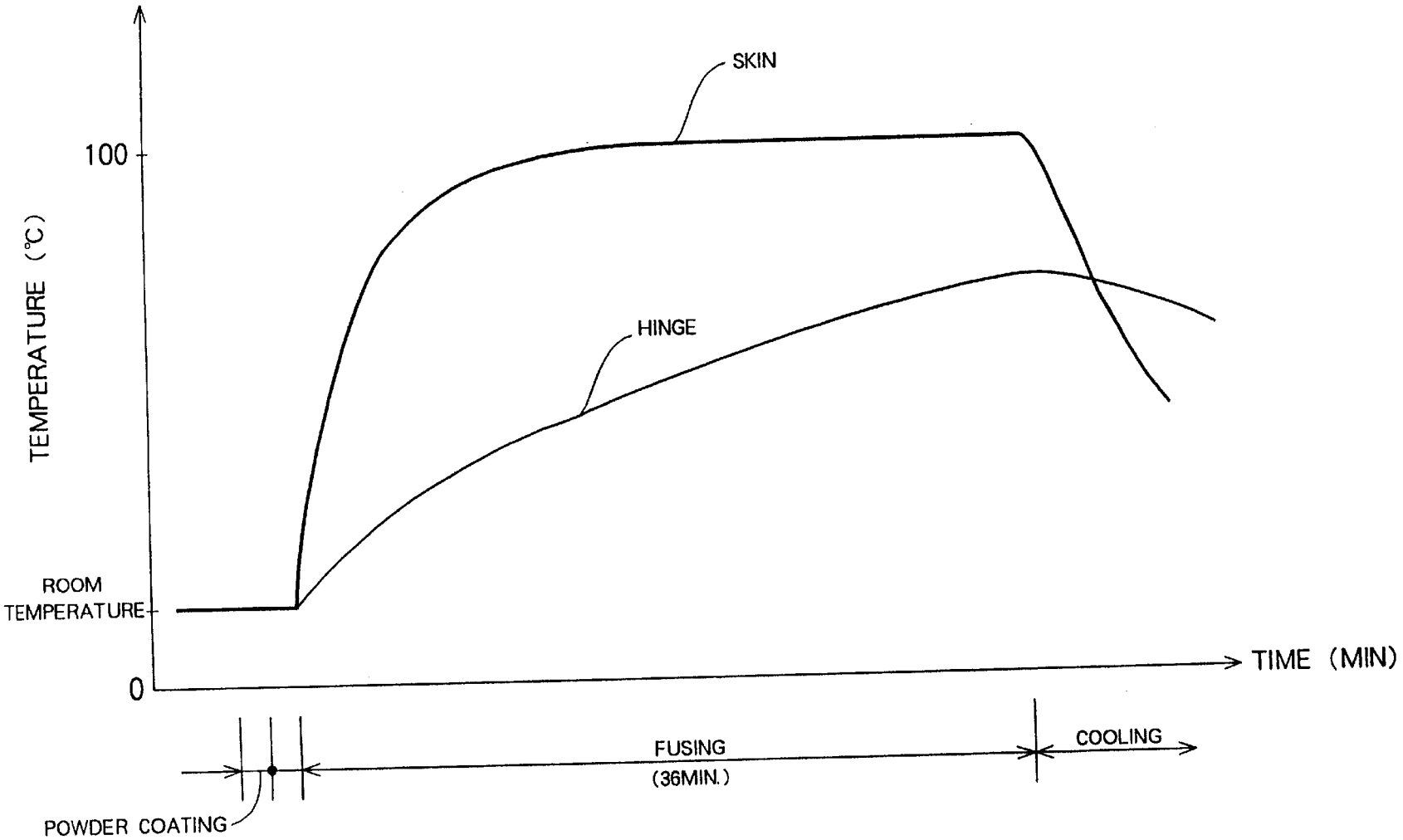
FIG. 9 (PRIOR ART)
FIG. 9 is a graph showing the conventional fusing temperature and time relationship.
Figure 10:
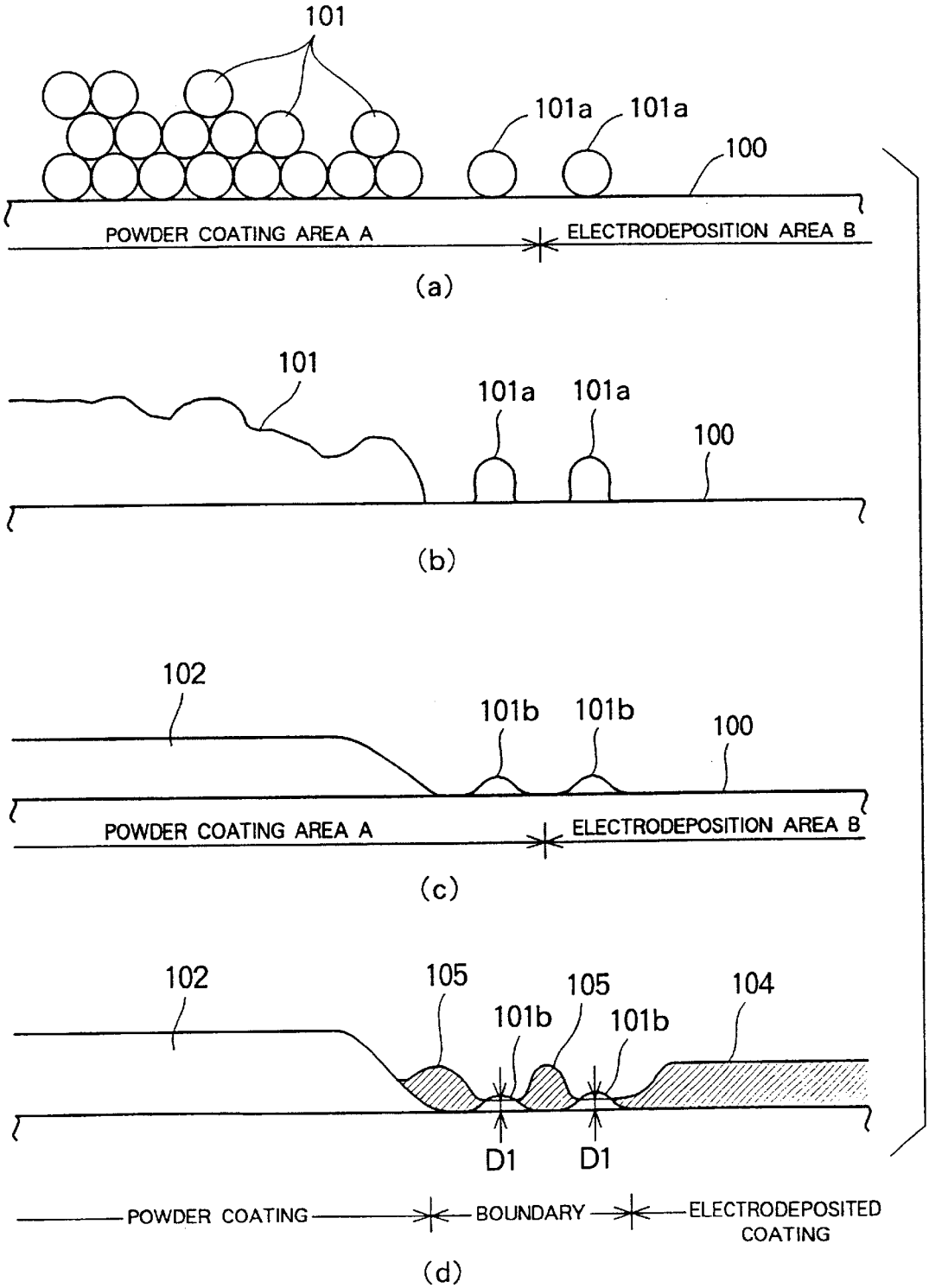
FIG. 10 (PRIOR ART)
FIGS. 10(*a*), 10(*b*), 10(*c*), and 10(*d*) are a set of diagrams showing a conventional pattern of reverse painting.

The temperature and time relationship as shown in FIG. 9 was employed in the former half of the reverse painting process. The results are shown by black circles in FIG. 4. The film had a thickness of 50 microns in the powder coating area at a distance of 30 mm from the boundary area, a thickness of 5 microns in the boundary area and a thickness of 35 microns in the electrodeposition area at a distance of 30 mm from the boundary area. It had a thickness of only 5 microns in its boundary area where it had a smaller thickness than in any other area.

Examples 2 to 5 and Comparative Examples 2 to 5 were carried out by employing the temperature and time relationships as shown in FIGS. 3 and 9, respectively.

(2) Salt Spray Test

A salt spray test was conducted in accordance with the JIS Z 2371 method, i.e., by cutting a notch in the film on a sample with a knife, exposing it to an aqueous salt solution for a certain length of time, bonding an adhesive tape to the film along the notch, peeling the tape off the film, and measuring the width of that portion of the film which peeled off with the tape. The sample was concluded as being acceptable if the width of any such film portion was within 2 or 4 mm. Further details of the test and the results thereof are shown in Table 1 below.

TABLE 1

| | | Salt spray test (JIS Z 2371) | | | | | |
|---|---|---|---|---|---|---|---|
| | | | | Width of peeled film | | | |
| | Material | Test duration | Standard for acceptance | Powder coating | Boundary | Electro deposition | Acceptance |
| Example 2 | Non-plated steel sheet | 960 Hr | Within 2 mm on one side | 1 mm | 1 mm | 1 mm | ○ |
| Comparative Example 2 | Non-plated steel sheet | 960 Hr | Within 2 mm on one side | 1 mm | 4 mm | 1 mm | x |
| Example 3 | Plated steel sheet | 480 Hr | Within 4 mm on one side | 1 mm | 3 mm | 1 mm | ○ |
| Comparative Example 3 | Plated steel sheet | 480 Hr | Within 4 mm on one side | 5.5 mm | 5 mm | 2.5 mm | x |

EXAMPLE 2

A painted sample of a non-plated steel sheet was tested for 960 hours. The width of that portion of the film which peeled off was 1 mm in all of the powder coating, boundary, and electrodeposition areas, or within the standard of 2 mm, and the sample was concluded as being acceptable.

Comparative Example 2

A painted sample of a non-plated steel sheet was tested for 960 hours. The width of that portion of the film which peeled off was 1 mm in the powder coating area, 4 mm in the boundary area and 1 mm in the electrodeposition area, and as it exceeded the standard of 2 mm in the boundary area, the sample was concluded as unacceptable. Spots of rust were also found in the boundary area even outside the notch.

EXAMPLE 3

A painted sample of a plated steel sheet was tested for 480 hours. The width of that portion of the film which peeled off was 1 mm in the powder coating area, 3 mm in the boundary area and 1 mm in the electrodeposition area, and as it was within the standard of 4 mm in all the areas, the sample was concluded as acceptable.

Comparative Example 3

A painted sample of a plated steel sheet was tested for 480 hours. The width of that portion of the film which peeled off was 5.5 mm in the powder coating area, 5 mm in the boundary area and 2.5 mm in the electrodeposition area, and as it exceeded the standard of 4 mm in two areas, the sample was concluded as unacceptable.

(3) Complex Corrosion Resistance Test

This is a test not specified by JIS, but conducted by repeating 50 cycles each consisting of wetting, salt spraying, drying, wetting, drying, wetting, drying and low temperature treatment (or air cooling). The test was conducted by cutting a notch in the film on a sample with a knife, repeating 50 cycles as stated above, bonding an adhesive tape to the film along the notch, peeling the tape off the film, and measuring the width of that portion of the film which peeled off with the tape. The sample was concluded as being acceptable if the width of any such film portion was within 4 mm (on one side), or 7 mm (on both sides). Further details of the test and the results thereof are shown in Table 2 below.

TABLE 2

Complex Corrosion Test

| | Material | Test cycles | Standard for acceptance | Width of peeled film: Powder coating | Boundary | Electro deposition | Acceptance |
|---|---|---|---|---|---|---|---|
| Example 4 | Non-plated steel sheet | 50 | Within 7 mm on one side | 4 mm | 7 mm | 4 mm | ○ |
| Comparative Example 4 | Non-plated steel sheet | 50 | Within 7 mm on one side | 4 mm | 12 mm | 4.5 mm | x |
| Example 5 | Plated steel sheet | 50 | Within 4 mm on one side | 3.5 mm | 2 mm | 4 mm | ○ |
| Comparative Example 5 | Plated steel sheet | 50 | Within 4 mm on one side | 4 mm | 4.5 mm | 3 mm | x |

Examples 4 and 5 are based on FIG. 3 while Comparative Examples are based on FIG. 9.

EXAMPLE 4

A painted sample of a non-plated steel sheet was tested for 50 cycles. The width of that portion of the film which peeled off was 4 mm in the powder coating area, 7 mm in the boundary area and 4 mm in the electrodeposition area, and as it was within the standard of 7 mm on both sides in all the areas, the sample was concluded as acceptable.

Comparative Example 4

A painted sample of a non-plated steel sheet was tested for 50 cycles. The width of that portion of the film which peeled off was 4 mm in the powder coating area, 12 mm in the boundary area and 4.5 mm in the electrodeposition area, and as it exceeded the standard of 7 mm on both sides in the boundary area, the sample was concluded as unacceptable.

EXAMPLE 5

A painted sample of a plated steel sheet was tested for 50 cycles. The width of that portion of the film which peeled off was 3.5 mm in the powder coating area, 2 mm in the boundary area and 4 mm in the electrodeposition area, and as it was within the standard of 4 mm on one side in all the areas, the sample was concluded as acceptable.

Comparative Example 5

A painted sample of a plated steel sheet was tested for 50 cycles. The width of that portion of the film which peeled off was 4 mm in the powder coating area, 4.5 mm in the boundary area and 3 mm in the electrodeposition area, and as it exceeded the standard of 4 mm on one side in the boundary area, the sample was concluded as unacceptable.

Figure 5:
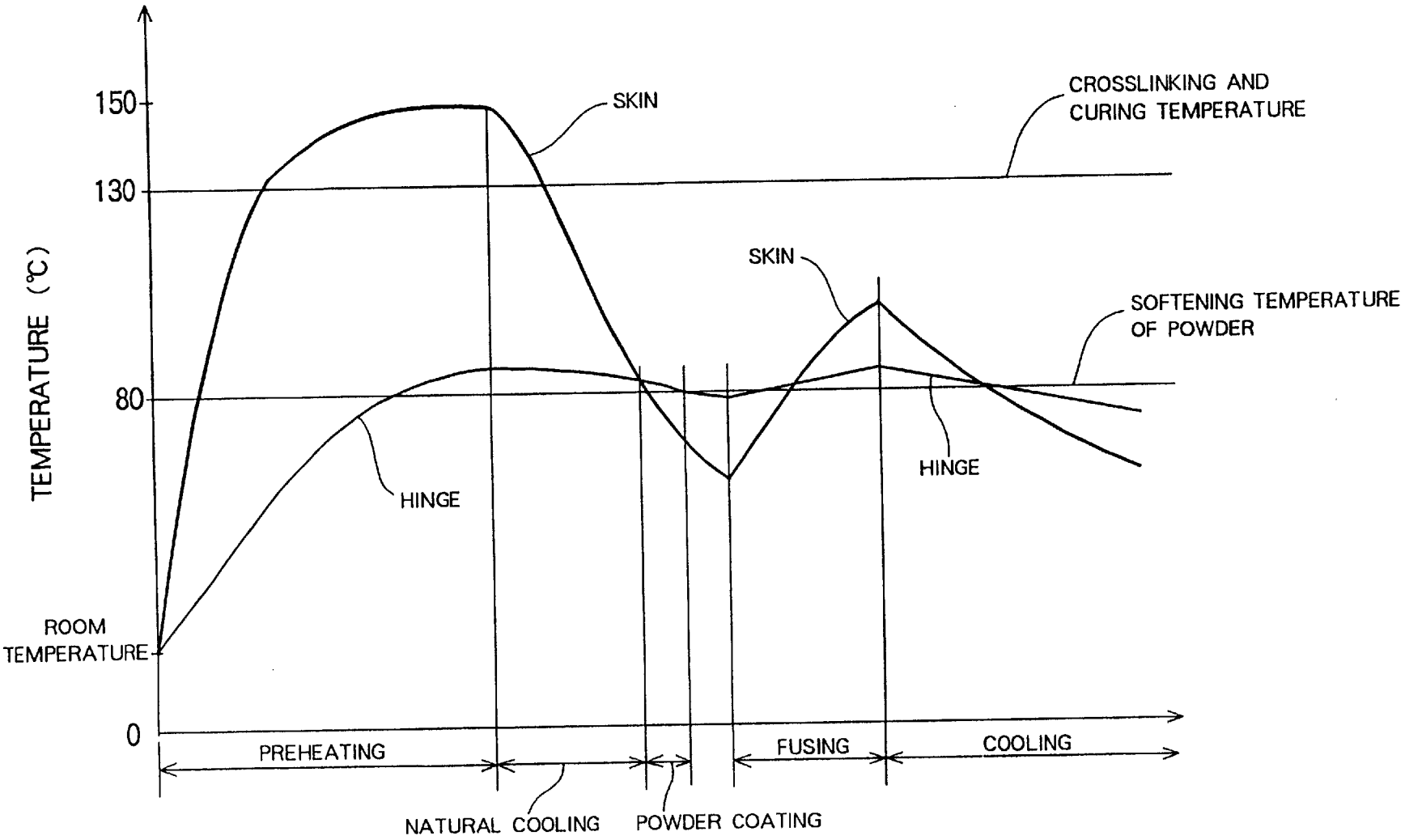
FIG. 5 is a graph similar to FIG. 3, but showing a modified form of the process shown therein.

FIG. 5 shows a modified form of the process shown in FIG. 3. The modified process employs 150° C. instead of 180° C. as the temperature of the preheating oven, and requires, therefore, a longer preheating time. The step of powder coating is started when the preheated skin and hinge has been allowed to cool to a temperature of about 83° C. which is higher than the softening temperature of the powdery paint (80° C). The fusing step is substantially identical to what has already been described with reference to FIG. 3, and no repeated description thereof is, therefore, made.

Figure 6:
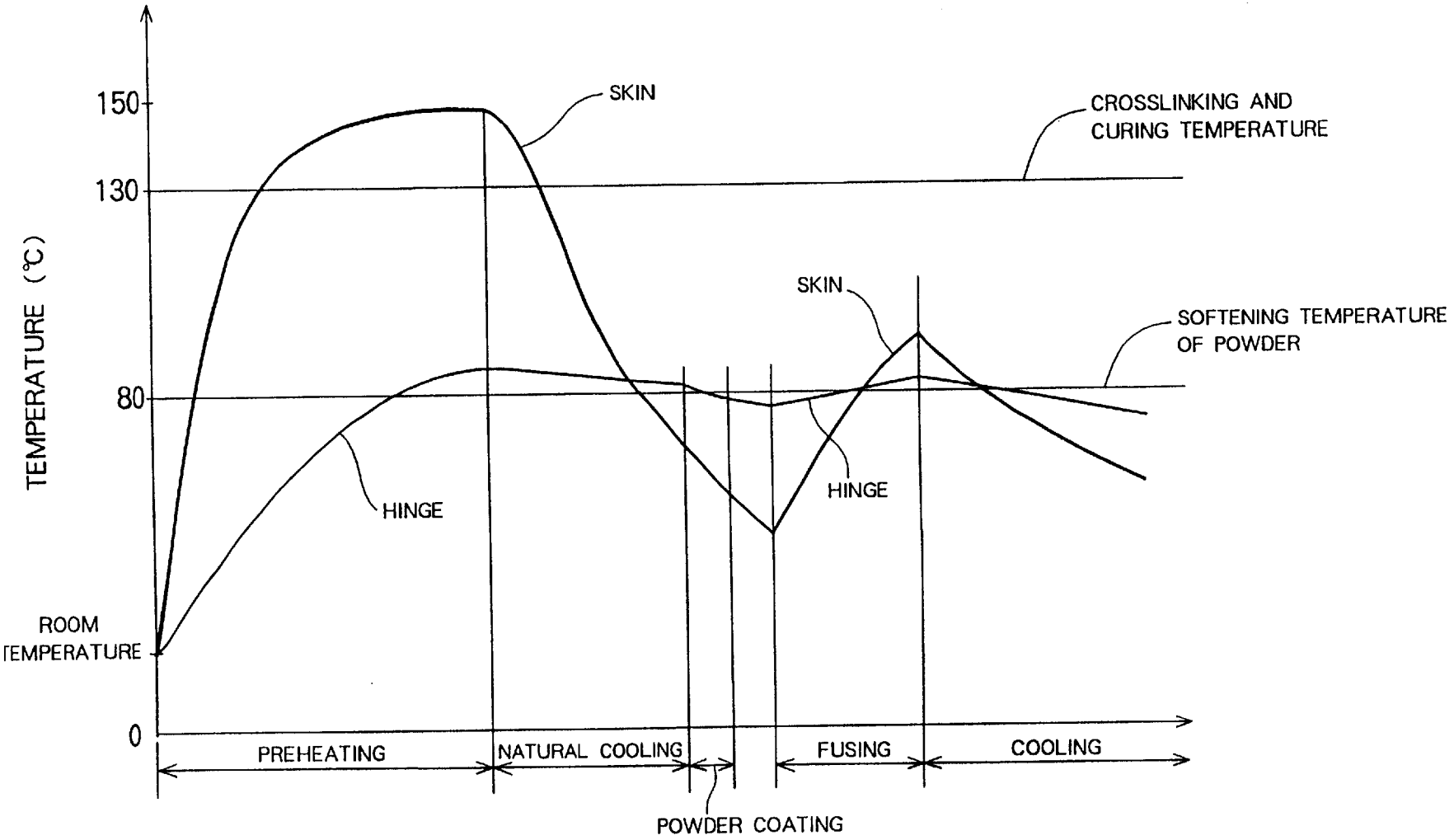
FIG. 6 is a graph similar to FIG. 3, but showing another modified form of the process shown therein.
Figure 7:
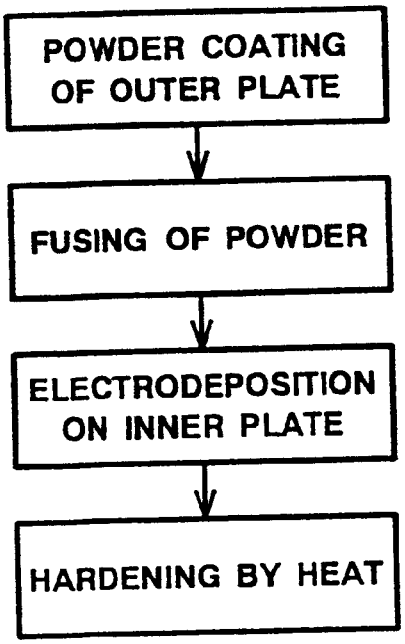
FIG.7 (PRIOR ART)
FIG. 7 is a chart showing a conventional reverse painting process.
Figure 8:
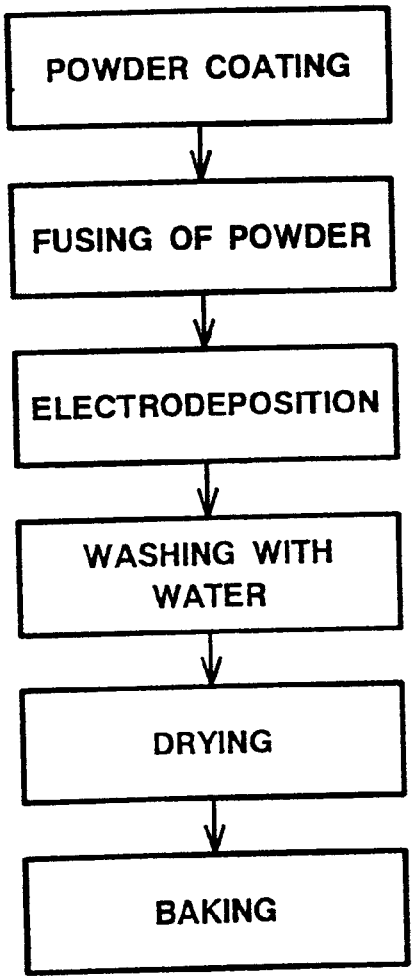
FIG.8 (PRIOR ART)
FIG. 8 is a chart showing another conventional reverse painting process.

FIG. 6 shows another modified form of the process shown in FIG. 3. The modified process employs a preheating temperature of 150° C. and a prolonged time for natural cooling, and includes the step for powder coating which is started when the skin has been cooled to below the softening temperature of the powdery paint (80° C.), while the hinge still stays at a higher temperature. The fusing step is substantially identical to what has already been described with reference to FIG. 3, and no repeated description thereof is, therefore, made.

The temperature and time relationships as shown in FIGS. 5 and 6 make it possible to form a coating film which is comparable in strength to what can be obtained by the process as shown in FIG. 3.

According to the process of this invention, therefore, it is possible to start the step of powder coating as soon as after the preheated work (such as a skin, or hinge) has been cooled to a temperature below the crosslinking and curing temperature of the powdery paint. If after powder coating, the work is placed in a fusing oven before it is cooled to ordinary (or room) temperature, the heat which it retains makes it possible to shorten the time required for the fusing step. The optimum timing for any such step depends on various factors including the construction of the work, its heat capacity and the nature of the paint employed.

What is claimed is:

1. A reverse painting process for a work to be painted with a powdery paint having a crosslinking and curing temperature and a softening point temperature, said work to be painted including steel sheets having various cooling rates, at least one of said cooling rates being faster and another of said cooling rates being slower, comprising the steps of:

using a first temperature above the crosslinking and curing temperature for preheating the work to be painted to second temperatures above the softening point temperature;

applying the powdery paint to the work upon cooling of the work so that a one of said steel sheets having the slower cooling rate cools below the softening point temperature during this applying step;

melting said powdery paint by heat at a third temperature above the softening point temperature, and below the crosslinking and curing temperature to form a film on the work in a fusing oven before the work is cooled to ambient temperature; and coating the work with an electrodeposited film.

2. A reverse painting process for a work to be painted with a powdery paint having a crosslinking and curing temperature and a softening point temperature, said work to be painted including steel sheets having various cooling rates, at least one of said cooling rates being faster and another of said cooling rates being slower, comprising the steps of:

washing the work to be painted;

using a first temperature above the crosslinking and curing temperature for preheating the work, while evaporating any remaining washing water therefrom;

applying the powdery paint to the work upon cooling of the work so that a one of said steel sheets having the slower cooling rate cools below the softening point temperature during this applying step;

melting said paint by heat at a temperature not below its softening point temperature, but below its crosslinking and curing temperature to form a film on the work in a fusing oven before the work is cooled to ambient temperature; and coating the work with an electrodeposited film.

* * * * *